US009607545B2

(12) United States Patent
Qian et al.

(10) Patent No.: US 9,607,545 B2
(45) Date of Patent: *Mar. 28, 2017

(54) ORGANIC LIGHT EMITTING DISPLAY AND PIXEL COMPENSATION CIRCUIT AND METHOD FOR ORGANIC LIGHT EMITTING DISPLAY

(71) Applicants: Shanghai Tianma Micro-Electronics Co., Ltd., Shanghai (CN); Tianma Micro-Electronics Co., Ltd., Shenzhen (CN)

(72) Inventors: Dong Qian, Shanghai (CN); Hanyu Gu, Shanghai (CN); Tong Zhang, Shanghai (CN)

(73) Assignees: SHANGHAI TIANMA MICRO-ELECTRONICS CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 299 days.

This patent is subject to a terminal disclaimer.

(21) Appl. No.: 14/462,195

(22) Filed: Aug. 18, 2014

(65) Prior Publication Data

US 2015/0187266 A1 Jul. 2, 2015

(30) Foreign Application Priority Data

Dec. 30, 2013 (CN) ..... 2013 1 0746962

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0861* (2013.01);
(Continued)

(58) Field of Classification Search
CPC ..... G09G 3/3233; G09G 2300/0819; G09G 2300/0861; G09G 2310/0251
(Continued)

(56) References Cited

U.S. PATENT DOCUMENTS 8,159,421 B2 4/2012 Hwang
2006/0103322 A1* 5/2006 Chung ..... G09G 3/3233 315/169.3

(Continued)

FOREIGN PATENT DOCUMENTS

CN 103077677 A 5/2013
CN 103150991 A 6/2013

OTHER PUBLICATIONS

German Application No. 102014210287.1, First Office Action prepared Aug. 3, 2016.

*Primary Examiner* — Chanh Nguyen
*Assistant Examiner* — Daniel Duong
(74) *Attorney, Agent, or Firm* — Alston & Bird LLP

(57) ABSTRACT

The present invention discloses a pixel compensation circuit and method for an organic light emitting display. The circuit comprises a first transistor, a second transistor, a third transistor, a fourth transistor, a driving transistor, a capacitor, and an organic light emitting element. The first transistor transmits a data signal to a first plate of the capacitor; the second transistor applies a reference voltage to the first plate of the capacitor; the driving transistor determines a magnitude of a driving current; the third transistor establishes a connection between the gate electrode and the drain electrode of the driving transistor; the fourth transistor passes the driving current from the driving transistor to the organic light emitting element; and the organic light emitting element emits light in response to the driving current.

17 Claims, 9 Drawing Sheets

(52) U.S. Cl.
CPC ..... *G09G 2310/0251* (2013.01); *G09G 2320/0233* (2013.01); *G09G 2320/045* (2013.01)

(58) Field of Classification Search
USPC ..... 345/77
See application file for complete search history.

(56) References Cited

U.S. PATENT DOCUMENTS

| | | | | |
|---|---|---|---|---|
| 2009/0167648 | A1* | 7/2009 | Jeon | G09G 3/3233 345/76 |
| 2011/0063198 | A1 | 3/2011 | Chung | |
| 2013/0169516 | A1* | 7/2013 | Chen | G09G 3/3258 345/76 |
| 2014/0292740 | A1* | 10/2014 | Tseng | G09G 3/3258 345/212 |
| 2015/0356919 | A1* | 12/2015 | Wang | G09G 3/3241 345/690 |

* cited by examiner

ORGANIC LIGHT EMITTING DISPLAY AND PIXEL COMPENSATION CIRCUIT AND METHOD FOR ORGANIC LIGHT EMITTING DISPLAY

CROSS-REFERENCES TO RELATED APPLICATIONS

This application claims the benefit of priority to Chinese Patent Application No. 201310746962.7, filed with the Chinese Patent Office on Dec. 30, 2013 and entitled "PIXEL COMPENSATION CIRCUIT AND METHOD FOR ORGANIC LIGHT EMITTING DISPLAY", the content of which is incorporated herein by reference in its entirety.

TECHNICAL FIELD

The present invention relates to the field of organic light emitting display technologies, in particular to an organic light emitting display, and a pixel compensation circuit and method for an organic light emitting display.

BACKGROUND OF THE INVENTION

An organic light emitting display is a film light emitting device made of organic semi-conductive material and driven by a direct current voltage, and the film light emitting device includes a glass substrate and a very thin layer of organic material coated on the glass substrate. When current flows through the organic material, the organic material emits lights actively without any backlight.

Because the luminescence brightness emitted by the organic light emitting display is related to a magnitude of the current flowing through the organic light emitting display, the electrical performance of thin film transistors (TFTs) acting as drivers for the organic light emitting display directly influence the display effect of the organic light emitting display. Specifically, a drift in the threshold voltage of a thin film transistor may cause an uneven brightness of the whole organic light emitting display.

To improve the display effect of the organic light emitting display, a driving circuit for pixel compensation is utilized in the organic light emitting display. FIG. 1 is a schematic view of a pixel compensation circuit for an organic light emitting display in the prior art. As shown in FIG. 1, the pixel compensation circuit includes one capacitor and five thin film transistors, among which thin film transistors T2 and T4 are turned on or off under the control of a signal SELECT, and thin film transistors T3 and T5 are turned on or off under the control of a signal EMIT. A reference voltage Vref is inputted via the thin film transistor T3, a data voltage Vdata is inputted via the thin film transistor T2, and a power supply voltage Vdd is inputted via a thin film transistor T1.

During a driving process of the pixel compensation circuit, initially the signal SELECT is at a low level while the signal EMIT is at a high level, such that data DATA is inputted to one end of the capacitor C1 and a threshold voltage Vth of the thin film transistor T1 is detected at the other end of the capacitor C1, and thus voltages on both ends of the capacitor C1 are Vdd−Vth and Vdata, respectively. Then, the signal SELECT changes to a high level and the signal EMIT changes to a low level, therefore the potential at a point B is Vref and the potential at a point A is Vref−Vdata+Vdd−Vth because of a coupling effect of the capacitor C1.

Then, a driving current for the light emitting of the organic light emitting element OLED in FIG. 1 is:

$$Ids=K(Vsg-Vth)^2=K(Vdd-(Vref-Vdata+Vdd-Vth)-Vth)^2=K(Vdata-Vref)^2 \quad (1),$$

where K is a constant. At this time, the magnitude of the driving current of the organic light emitting element OLED is irrelevant to the threshold voltage of the driving transistor, such that a function of pixel compensation is realized.

However, the above mentioned calculation is theoretically ideal. In practice, voltages at both ends of the capacitor C1 change simultaneously when the signal SELECT is at a low level and the signal EMIT is at a high level. If the size of the data DATA in the current frame is much larger than that of the data DATA in the preceding frame, then due to the coupling effect of the capacitor C1 at the moment when the signal SELECT is changed from a high level to a low level, the potential at the point A is pulled up to a very high level instantly. As a result, in the period of detecting the threshold voltage of the thin film transistor T1, the detected threshold voltage Vth' is inaccurate and is different from the actual threshold voltage Vth by ΔVth, which leads to the inaccuracy of subsequent threshold compensation. That is, if the potential at the point A is Vref−Vdata+Vdd−Vth', then the driving current of the organic light emitting element OLED is $$Ids=K(Vsg-Vth)^2=K(Vdata-Vref+\Delta Vth)^2 \quad (2)$$

It can be seen from the above equation the pixel compensation is ineffective because of the presence of the ΔVth, and the organic light emitting display still has the problem of uneven brightness.

BRIEF SUMMARY OF THE INVENTION

In view of this, embodiments of the present invention provide a pixel compensation circuit and method for an organic light emitting display to solve the technical problem of the low precision of the pixel compensation for the organic light emitting display, to implement accurate compensation for the threshold voltage.

One aspect of the present invention discloses a pixel compensation circuit for an organic light emitting display, comprising a first transistor, a second transistor, a third transistor, a fourth transistor, a driving transistor, a capacitor, and an organic light emitting element; wherein, the first transistor, which is under the control of a first driving signal, is configured to control the transmission of a data signal to a first plate of the capacitor; the second transistor, which is under the control of a second driving signal, is configured to control the application of a reference voltage to the first plate of the capacitor; the driving transistor is configured to determine a magnitude of a driving current, wherein the driving current depends on a voltage difference between a gate electrode and a source electrode of the driving transistor; the third transistor, which is under the control of the first driving signal, is configured to control the connecting and disconnecting between the gate electrode and the drain electrode of the driving transistor; the fourth transistor, which is under the control of a third driving signal, is configured to conduct the driving current from the driving transistor to an organic light emitting element; and the organic light emitting element is configured to emit light in response to the driving current.

Another aspect of the present invention discloses a method for making pixel compensations using the pixel compensation circuit, the pixel compensation circuit comprising a first transistor, a second transistor, a third transistor, a fourth transistor, a driving transistor, and a capacitor, wherein, the first transistor, which is under the control of a first driving signal, is configured to control the transmission of a data signal to a first plate of the capacitor; the second transistor, which is under the control of a second driving signal, is configured to control the application of a reference voltage to the first plate of the capacitor; the driving transistor is configured to determine a magnitude of a driving current, wherein the driving current depends on a voltage difference between a gate electrode and a source electrode of the driving transistor; the third transistor, which is under the control of the first driving signal, is configured to control the connecting and disconnecting between the gate electrode and the drain electrode of the driving transistor; and the fourth transistor, which is under the control of a third driving signal, is configured to conduct the driving current from the driving transistor to an organic light emitting element; wherein, the first transistor, the second transistor, the third transistor, the fourth transistor, and the driving transistor are p-type transistors; or the first transistor, the second transistor, the third transistor, and the fourth transistor are n-type transistors and the driving transistor is a p-type transistor; the method comprises: a node resetting step, a threshold detecting step, a data inputting step, and a light emitting step.

Preferably, in the node resetting step, if the first transistor, the second transistor, the third transistor, the fourth transistor, and the driving transistor are p-type transistors, the first driving signal and the third driving signal are at a low level and the second driving signal is at a high level, so that the first transistor, the third transistor, the fourth transistor, and the driving transistor are turned on and the second transistor is turned off;

if the first transistor, the second transistor, the third transistor, and the fourth transistor are n-type transistors and the driving transistor is a p-type transistor, the first driving signal and the third driving signal are at a high level and the second driving signal is at a low level, so that the first transistor, the third transistor, the fourth transistor, and the driving transistor are turned on and the second transistor is turned off.

Preferably, in the threshold detecting step, if the first transistor, the second transistor, the third transistor, the fourth transistor, and the driving transistor are p-type transistors, the first driving signal is at a low level, the second driving signal is at a high level and the third driving signal changes from a low level to a high level, so that the first transistor and the third transistor are turned on, the second transistor and the fourth transistor are turned off, and the driving transistor is turned off if a voltage difference between the gate electrode and the source electrode of the driving transistor is equal to a threshold voltage of the driving transistor; and if the first transistor, the second transistor, the third transistor, and the fourth transistor are n-type transistors and the driving transistor is a p-type transistor, the first driving signal is at a high level, the second driving signal is at a low level, and the third driving signal changes from a high level to a low level, so that the first transistor and the third transistor are turned on, the second transistor and the fourth transistor are turned off, and the driving transistor is turned off if the voltage difference between the gate electrode and the source electrode of the driving transistor is equal to the threshold voltage of the driving transistor.

The present invention reduces the impact of an parasitic capacitance coupling effect on the potential at a node and solves the problem of inaccurate threshold detecting, by ensuring that voltages at both ends of a storage capacitor do not change simultaneously in the process of compensating the threshold voltage and the power supply line voltage drop, therefore, the threshold voltage is precisely compensated to achieve a good displaying effect.

DETAILED DESCRIPTION OF THE INVENTION

Technical solutions of the present invention will be described below in conjunction with accompanying drawings and with reference to specific embodiments. It is to be understood that the specific embodiments described herein are only illustrative of the invention but not to limit the present invention herein. It should be additionally noted that, for ease of description, only relevant parts but not all parts of the present invention are shown in the accompanying drawings.

Figure 1:
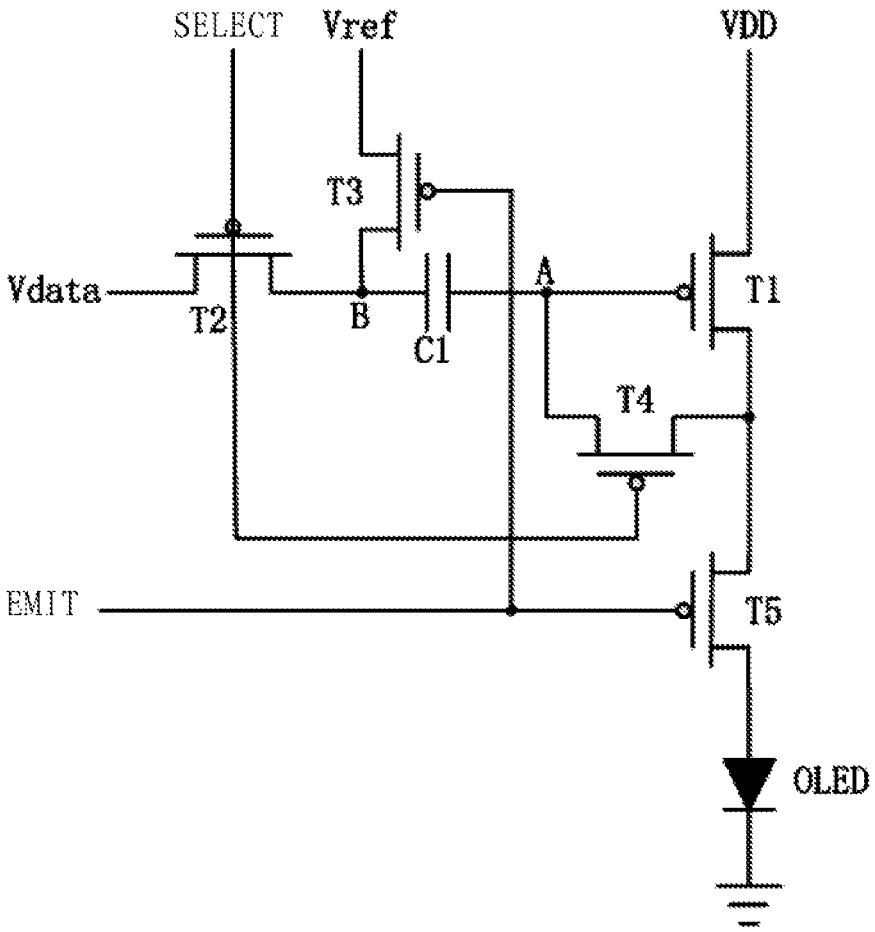
Prior Art FIG.1
FIG. 1 is a schematic view of a pixel compensation circuit for an organic light emitting display in the prior art.
Figure 2:
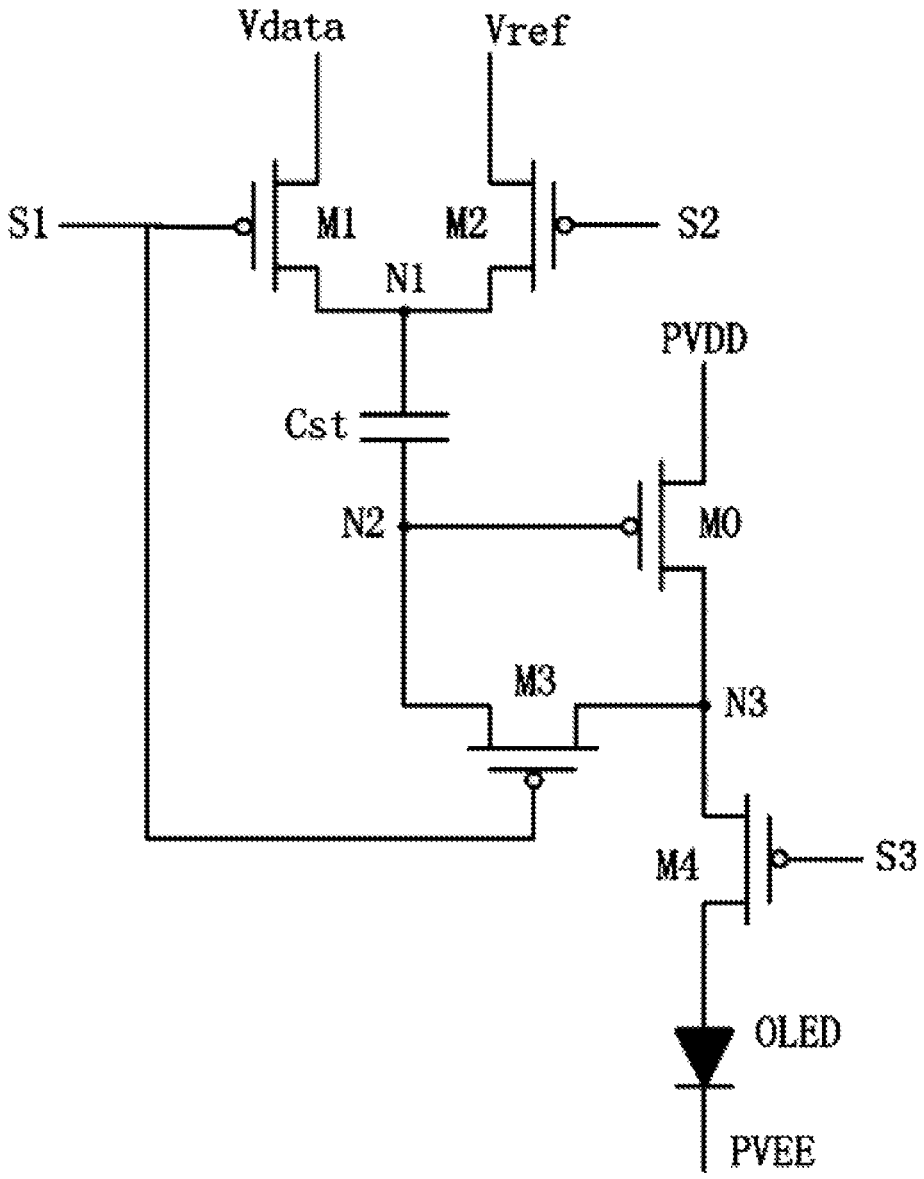
FIG. 2 is a schematic view of a pixel compensation circuit for an organic light emitting display according to an embodiment of the present invention.

FIG. 2 is a schematic view of a pixel compensation circuit for an organic light emitting display according to an embodiment of the present invention. As shown in FIG. 2, the pixel compensation circuit of this embodiment includes a first transistor M1, a second transistor M2, a third transistor M3, a fourth transistor M4, a driving transistor M0, a capacitor Cst, and an organic light emitting element OLED.

A first electrode of the first transistor M1 is connected to a data signal line to receive a data signal Vdata, a second electrode of the first transistor M1 is connected to a second electrode of the second transistor M2 and a first plate of the capacitor Cst, and a first electrode of the second transistor M2 is connected to a reference voltage line to receive a reference voltage Vref. A source electrode of the driving transistor M0 is connected to a power supply voltage line to receive a power supply voltage PVDD, and a drain electrode of the driving transistor M0 is connected to a second electrode of the third transistor M3 and a first electrode of the fourth transistor M4. A first electrode of the third transistor M3 is connected to a gate electrode of the driving transistor M0 and a second plate of the capacitor Cst. A second electrode of the fourth transistor M4 is connected to the organic light emitting element OLED.

In the pixel compensation circuit of this embodiment, the first transistor M1 is controlled by a first driving signal S1 to control the transmission of the data signal Vdata to the first plate of the capacitor Cst. The second transistor M2 is controlled by a second driving signal S2 to control the transmission of the reference voltage Vref to the first plate of the capacitor Cst. The driving transistor M0 is configured to determine the magnitude of a driving current, which depends on a voltage difference between the gate electrode and the source electrode of the driving transistor M0. The third transistor M3 is controlled by the first driving signal S1 to establish a connection between the gate electrode and the drain electrode of the driving transistor M0. The fourth transistor M4 is controlled by a third driving signal S3 to pass the driving current from the driving transistor M0 to the organic light emitting element OLED. The organic light emitting element OLED is configured to emit lights in response to the driving current.

Figure 3:
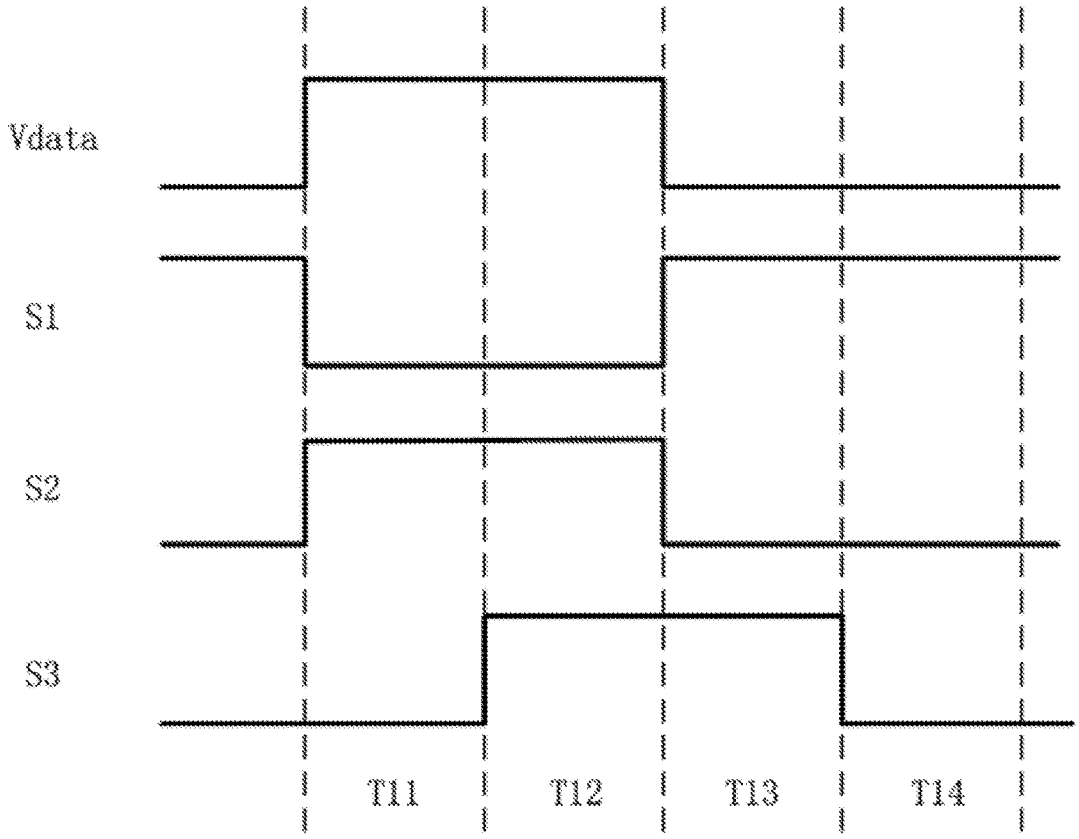
FIG. 3 is a time sequence diagram of driving signals of the pixel compensation circuit for an organic light emitting display according to an embodiment of the present invention.

FIG. 3 is a time sequence diagram of driving signals of the pixel compensation circuit for an organic light emitting display according to an embodiment of the present invention. It shall be noted that the time sequence diagram shown in FIG. 3 is merely an example corresponding to the case in which the first transistor M1, the second transistor M2, the third transistor M3, the fourth transistor M4, and the driving transistor M0 are p-type transistors.

In particular, the first driving signal S1 controls the first transistor M1 and the third transistor M3, the second driving signal S2 controls the second transistor M2, the third driving signal S3 controls the fourth transistor M4, and Vdata represents a data signal. Each of the first driving signal S1, the second driving signal S2 and third driving signal S3 is provided by a gate electrode driving line of the organic light emitting display.

The time sequence of the driving by the pixel compensation circuit of this embodiment includes a node reset stage, a threshold detecting stage, a data inputting stage, and a light emitting stage, which correspond to time periods T11, T12, T13 and T14 in FIG. 3, respectively.

Figure 4:
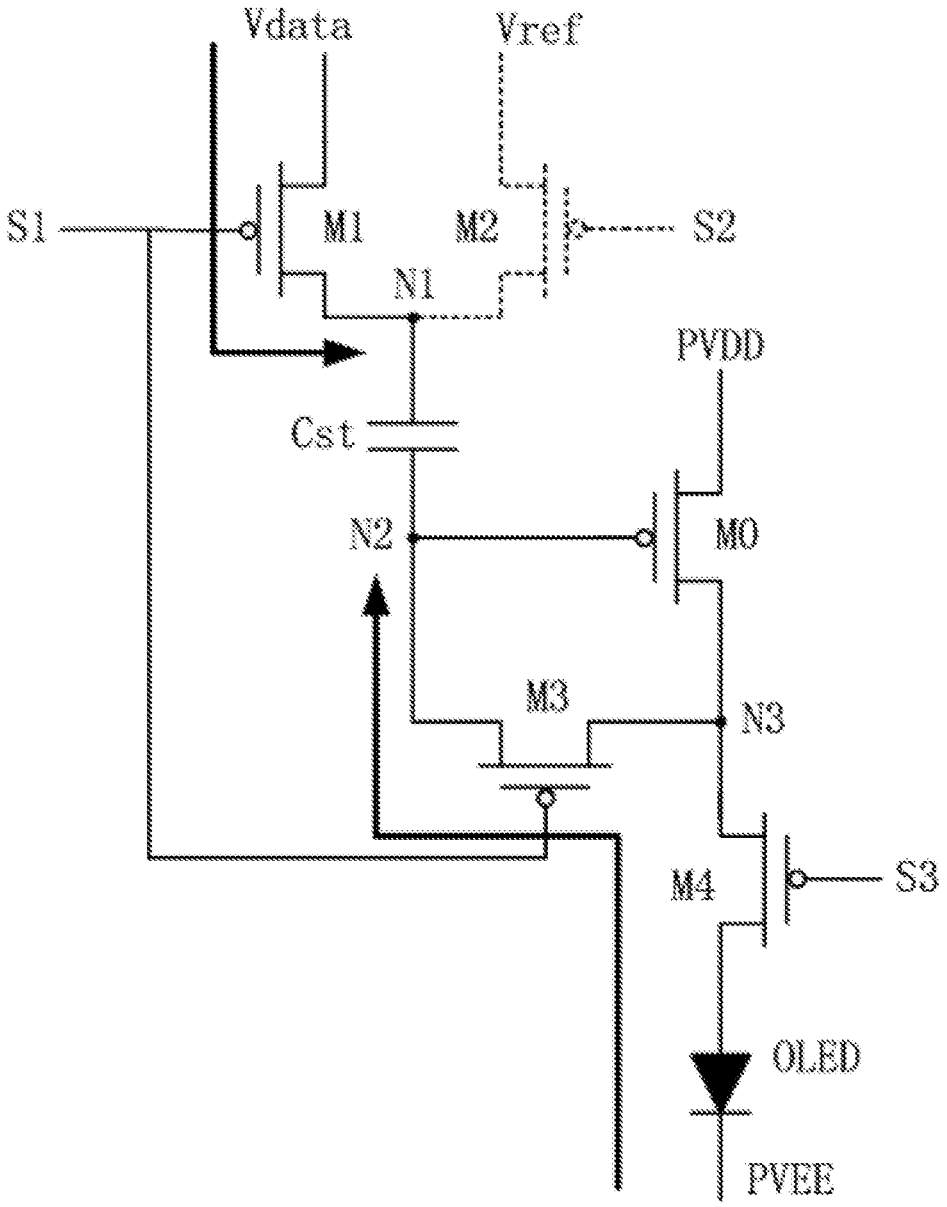
FIG. 4 is a schematic view showing a current path during a node reset stage T11 of the pixel compensation circuit for an organic light emitting display according to an embodiment of the present invention.
Figure 5:
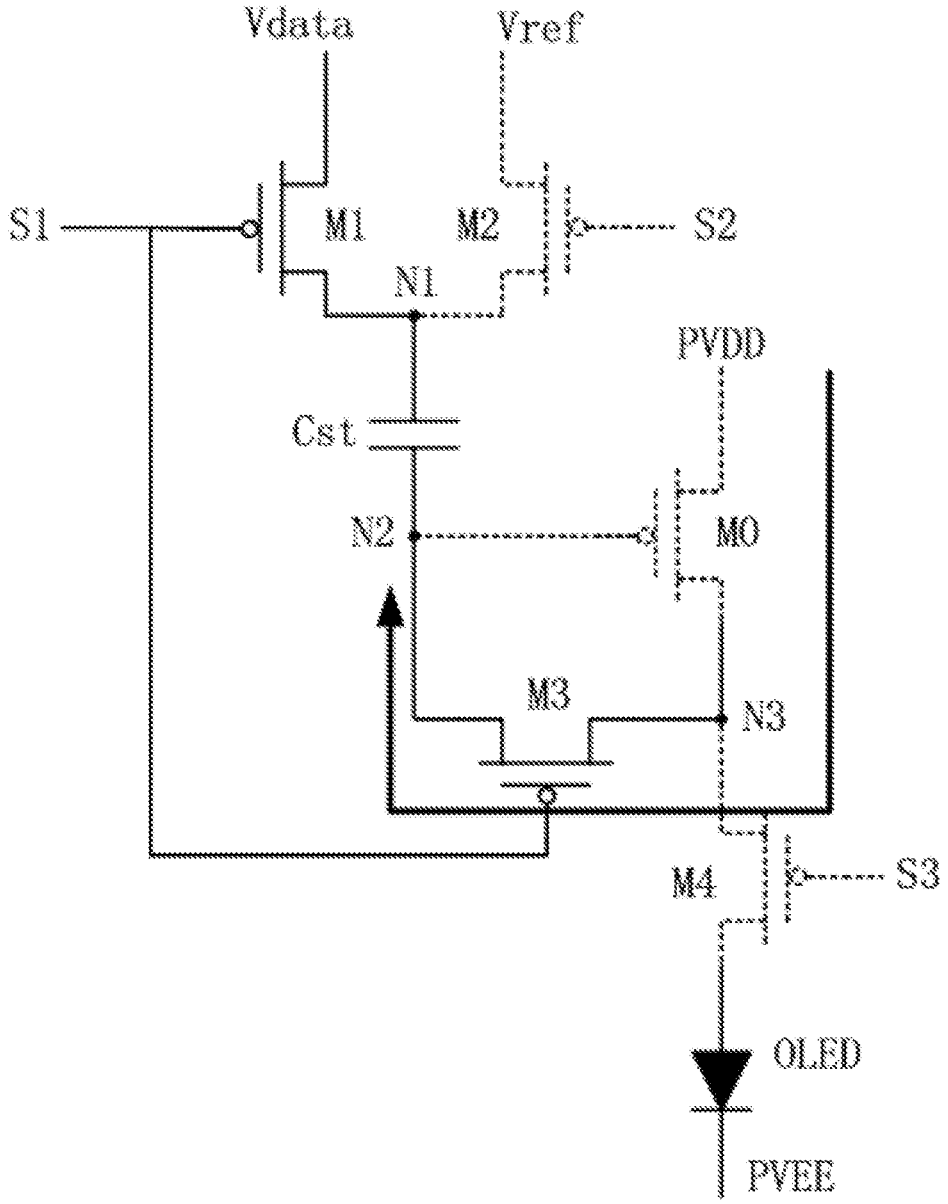
FIG. 5 is a schematic view showing a current path during a threshold detecting stage T12 of the pixel compensation circuit for an organic light emitting display according to an embodiment of the present invention.
Figure 6:
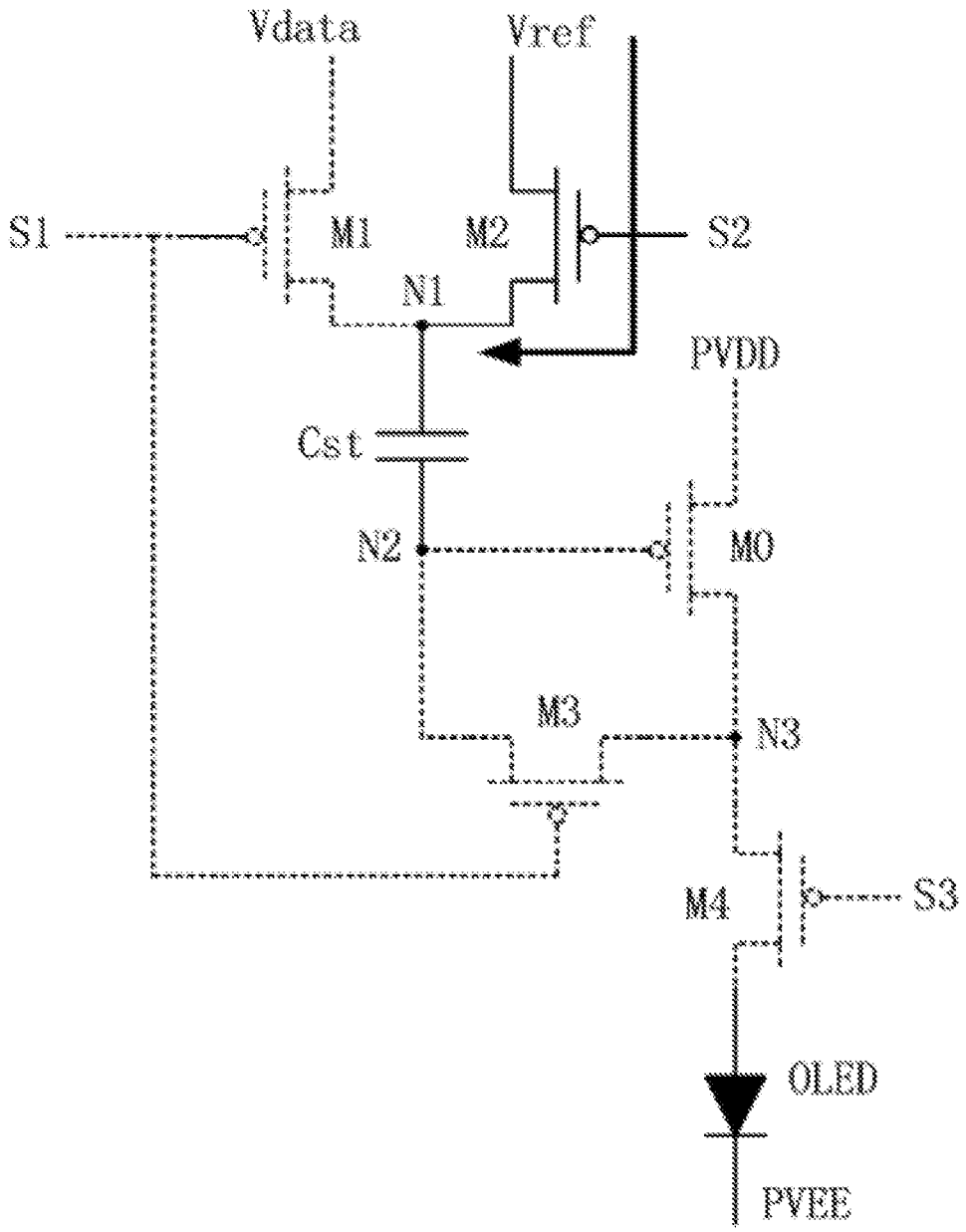
FIG. 6 is a schematic view showing a current path during a data inputting stage T13 of the pixel compensation circuit for an organic light emitting display according to an embodiment of the present invention.
Figure 7:
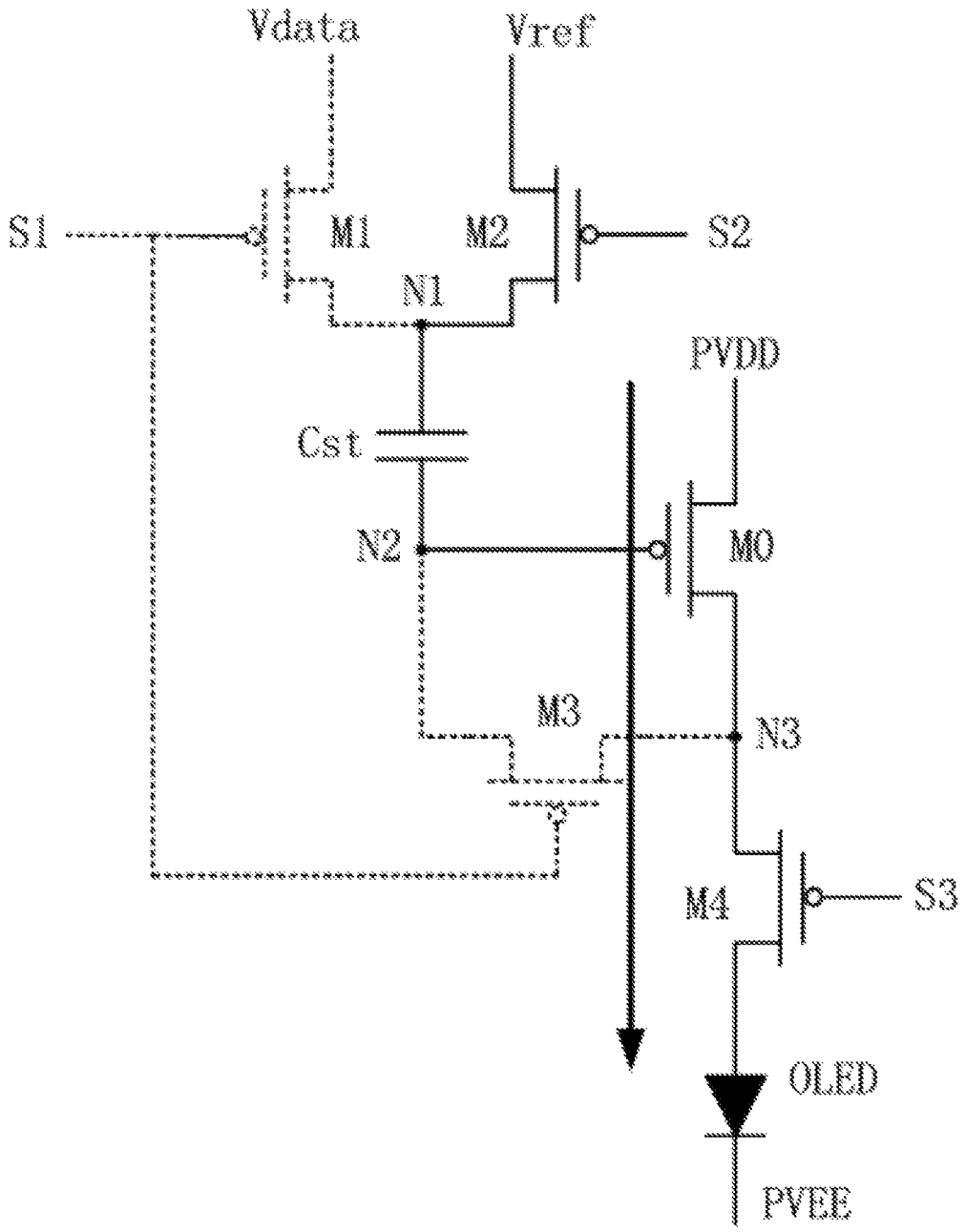
FIG. 7 is a schematic view showing a current path during a light emitting stage T14 of the pixel compensation circuit for an organic light emitting display according to an embodiment of the present invention.

FIG. 4 is a schematic view showing a current path during the node reset stage T11. FIG. 5 is a schematic view showing a current path during the threshold detecting stage T12. FIG. 6 is a schematic view showing a current path during the data inputting stage T13. FIG. 7 is a schematic view showing a current path during the light emitting stage T14. For ease of description, the current paths are indicated by arrows and the transistor(s) in an off state are shown by dotted lines in FIGS. 4 to 7.

Operational principles of the pixel compensation circuit for the organic light emitting display of an embodiment of the present invention will be described in conjunction with FIGS. 2 to 7 below.

As shown in FIGS. 3 and 4, in the node reset stage T11, the first driving signal S1 is at a low level, so that the first transistor M1 and the third transistor M3 are turned on. The second driving signal S2 is at a high level, so that the second transistor M2 is turned off. The third driving signal S3 is at a low level, so that the fourth transistor M4 is turned on. It can be seen from FIG. 4 that the data signal Vdata is transmitted to a first node N1, i.e. to the first plate of the capacitor Cst through the first transistor M1. Meanwhile, a current path is formed between the third transistor M3 and the fourth transistor M4, and a a low level PVEE at a cathode of the organic light emitting element OLED is applied to a second node N2 through the current path between the third and fourth transistors M3 and M4, as a result, the second plate of the capacitor Cst and the gate electrode of the driving transistor M0 are at a low level, so that the node reset stage of the pixel compensation circuit is completed.

As shown in FIGS. 3 and 5, in the threshold detecting stage T12, the first driving signal S1 is at a low level, so that the first transistor M1 and the third transistor M3 are turned on. The second driving signal S2 is at a high level, so that the second transistor M2 is turned off. The third driving signal S3 is at a high level, so that the fourth transistor M4 is turned off. It can be seen from FIG. 5 that the gate electrode of the driving transistor M0 is at a low level so that the driving transistor M0 is turned on in the node reset stage T11, therefore a current path is formed between the driving transistor M0 and the third transistor M3, and the power supply voltage PVDD is applied to the second node N2 through the formed current path between the driving transistor M0 and the third transistor M3, to pull up the potential at the second node N2 progressively. According to the voltage-current characteristic of a transistor, if the voltage difference between the gate electrode and the source electrode of the transistor is less than the threshold voltage of the transistor, the transistor is turned off. That is, if the voltage of the gate electrode of the driving transistor M0 is pulled up to an extent that the voltage difference between the gate electrode and the source electrode of the driving transistor M0 is less than or equal to the threshold voltage Vth of the driving transistor M0, the driving transistor M0 is turned off. The potential at the source electrode of the driving transistor M0 will be maintained at the power supply voltage PVDD because the source electrode is connected to the power supply voltage line, therefore, when the driving transistor M0 is turned off, the potential at the gate electrode of the driving transistor M0 is changed as PVDD−Vth, where PVDD represents the power supply voltage and Vth represents the threshold voltage of the driving transistor M0.

At this point, the voltage difference Vc between the first plate and the second plate of the capacitor Cst is:

$$Vc=V2-V1=PVDD-Vth-Vdata \quad (3),$$

Wherein, V2 represents the potential at the second node N2, and V1 represents the potential at the first node N1.

During the threshold detecting stage T12, the voltage difference Vc between the first plate and the second plate of the capacitor Cst contains the threshold voltage Vth of the driving transistor M0. That is, the threshold voltage Vth of the driving transistor M0 has been detected and stored in the capacitor Cst in the threshold detecting stage T12.

As shown in FIGS. 3 and 6, in the data inputting stage T13, the first driving signal S1 is at a high level, so that the first transistor M1 and the third transistor M3 are turned off. The second driving signal S2 is at a low level, so that the second transistor is turned on. The third driving signal S3 is at a high level, so that the fourth transistor M4 is turned off. It can be seen from FIG. 6 that the reference voltage Vref is applied through the second transistor M2 to the first node N1, i.e., the first plate of the capacitor Cst. Meanwhile, the third transistor M3, the fourth transistor M4, and the driving transistor M0 are in an off state, that is, the second plate of the capacitor Cst is suspended (or disconnected), therefore, the voltage difference Vc between the first plate and the second plate of the capacitor Cst is maintained constant. However, since the potential at the first node N1 is changed to Vref, the potential at the second node N2 is change to:

$$V2'=Vc+V1'=PVDD-V\text{th}-V\text{data}+V\text{ref} \quad (4).$$

That is, the data signal Vdata is coupled to the second plate of the capacitor Cst through the capacitor Cst.

As shown in FIGS. 3 and 7, in the light emitting stage T14, the first driving signal S1 is at a high level, so that the first transistor M1 and the third transistor M3 are turned off. The second driving signal S2 is at a low level, so that the second transistor M2 is turned on. The third driving signal S3 is at a low level, so that the fourth transistor M4 is turned on. It can be seen from FIG. 7 that a current path is formed between the driving transistor M0 and the fourth transistor M4. At this time, the voltage Vgs across the gate electrode and the source electrode of the driving transistor M0 is:

$$Vgs=V2'-PVDD=V\text{ref}-V\text{th}-V\text{data} \quad (5).$$

Since the driving transistor M0 is operating in a saturation region, a driving current flowing through a channel of the driving transistor M0 is determined by the voltage difference between the gate electrode and the source electrode of the driving transistor M0. Therefore, according to the electrical characteristic of the transistor operating in the saturation region, the driving current is obtained as:

$$I=K(Vsg-V\text{th})^2=K(V\text{ref}-V\text{data})^2 \quad (6),$$

where I denotes the driving current generated by the driving transistor M0, K is a constant, Vref represents the reference voltage, and Vdata represents the data signal.

Because the fourth transistor M4 is operating in a linear region, the driving current I can flow to the organic light emitting element OLED via the fourth transistor M4, to drive the organic light emitting element OLED to emit lights for displaying.

In a preferred embodiment of the present invention, the signal line of the second driving signal S2 in the current pixel may be connected to a third driving signal line of a preceding pixel, while the signal line of the third driving signal S3 in the current pixel may be connected to a second driving signal line of a next pixel, thus a layout design of an integrated circuit board is further simplified while achieving the pixel compensation function of the present invention.

It is noted that the first transistor M1, the second transistor M2, the third transistor M3, and the fourth transistor M4 may be n-type transistors, while the driving transistor M0 is a p-type transistor. It can be understood by those skilled in this art that, the actions in each of the steps described above can be achieved as well by inverting the first driving signal S1, the second driving signal S2 and the third driving signal S3, this will not be repeatedly described herein.

It can be seen from the above equation (6) that the magnitude of the driving current I only depends on the reference voltage and the data signal, and is independent of the threshold voltage of the driving transistor and the power supply voltage, thereby achieving the effect of compensating the threshold voltage and a power supply line voltage drop. Moreover, during the entire driving process of the pixel compensation circuit, it is ensured that the voltages at both ends of a storage capacitor will not change simultaneously, so as to reduce the impact of a parasitic capacitance coupling effect on the potential of a node, and to solve the problem of inaccurate threshold detecting, thus an accurate pixel compensation effect is achieved in the organic light emitting display, obtaining good displaying effect.

Figure 8:
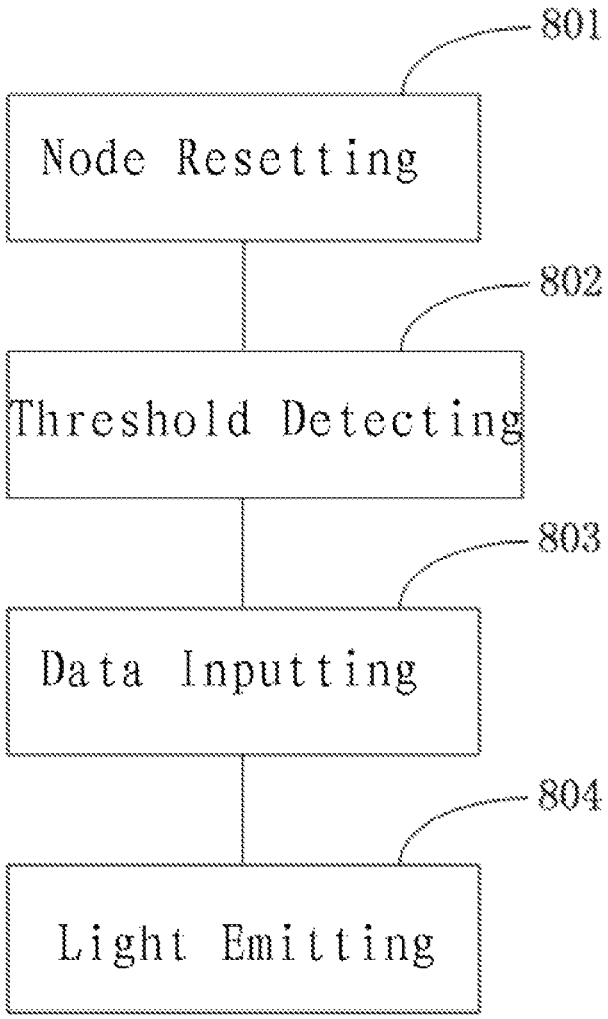
FIG. 8 is a flow chart of a pixel compensation method for an organic light emitting display according to one embodiment of the present invention.

FIG. 8 is a flow chart of a pixel compensation method for an organic light emitting display according to one embodiment of the present invention. In this embodiment, each of the first transistor M1, the second transistor M2, the third transistor M3, the fourth transistor M4, and the driving transistor M0 is a p-type transistor. As shown in FIG. 8, the pixel compensation method includes following Steps 801 to 804.

Step 801: Node Resetting.

Specifically, in the step of node resetting, the first driving signal and the third driving signal are at a low level and the second driving signal is at a high level, in this case, the first transistor, the third transistor, the fourth transistor, and the driving transistor are turned on and the second transistor is turned off. The data signal is transmitted to the first plate of the capacitor through the first transistor.

Step 802: Threshold Detecting.

Specifically, in the step of threshold detecting, the first driving signal is at a low level, the second driving signal is at a high level, and the third driving signal changes from the low level to the high level, in this case, the first transistor and the third transistor are turned on, the second transistor and the fourth transistor are turned off, and the driving transistor will be turned off if the voltage difference between the gate electrode and the source electrode of the driving transistor is equal to a threshold voltage of the driving transistor. When the driving transistor is turned off, the threshold voltage of the driving transistor is stored in the capacitor.

Step 803: Data Inputting.

Specifically, in the step of data inputting, the first driving signal changes from the low level to the high level, the second driving signal changes from a high level to a low level, and the third driving signal is at a high level, thus, the first transistor, the third transistor, the fourth transistor, and the driving transistor are turned off and the second transistor is turned on. The data signal is coupled to the second plate of the capacitor through the first transistor.

Step 804: Light Emitting.

Specifically, in the step of light emitting, the first driving signal is at a high level, the second driving signal is at a low level, and the third driving signal changes from a high level to a low level, thus, the first transistor and the third transistor are turned off, the second transistor and the fourth transistor are turned on, and the driving current of the driving transistor depends on the voltage difference between the gate electrode and the source electrode of the driving transistor. The driving current flows to the organic light emitting element via the fourth transistor, so that the organic light emitting element emits light for displaying in response to the driving current.

Figure 9:
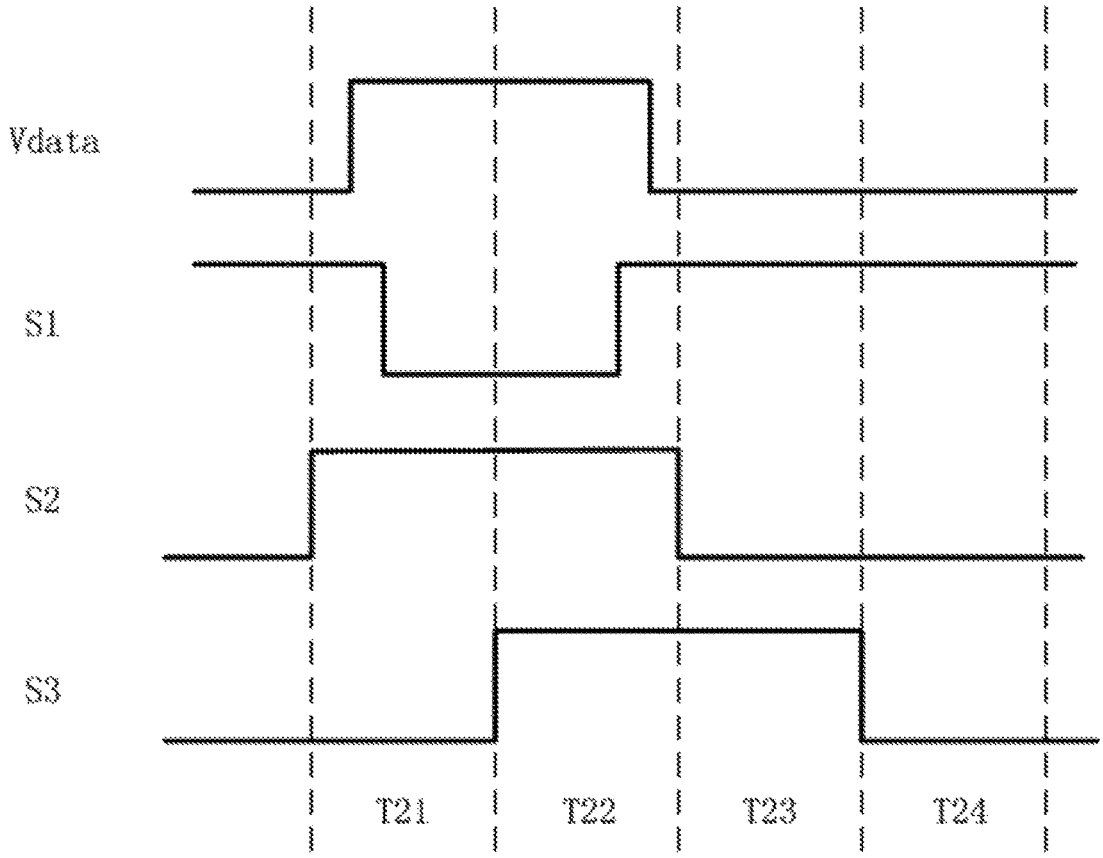
FIG. 9 is a time sequence diagram of driving signals of the pixel compensation circuit according to one embodiment of the present invention.

FIG. 9 is a time sequence diagram of driving signals of one embodiment of the present invention. In this embodiment of the present invention, as shown in FIG. 9, in the node resetting step corresponding to a time sequence T21, the data signal Vdata changes from a low level to a high level. In the threshold detecting step corresponding to a time sequence T22, the data signal Vdata changes from a high level to a low level. Moreover, in the node resetting step corresponding to the time sequence T21, after the data signal Vdata changes from the low level to the high level, the first driving signal S1 changes from a high level to a low level. In the threshold detecting step corresponding to the time sequence T22, before the data signal Vdata changes from a high level to a low level, the first driving signal S1 changes from a low level to a high level. That is, the time duration when the first transistor M1 is at an on state is slightly shorter than the time duration when the data signal Vdata is at a high level. In this way, it is ensured that when the first transistor M1 is turned on under the control of the first driving signal S1, the data signal Vdata will inevitably be transmitted through the first transistor M1 to the first node N1, i.e., the first plate of the capacitor Cst, such that the data signal Vdata is maintained unchanged in a stage during which the first driving signal S1 is turned on.

In this preferred embodiment, the variations of the second driving signal S2 and third driving signal S3, as well as the variations of each signal in the data inputting step (corresponding to the time sequence T23) and the light emitting step (corresponding to the time sequence T24), are the same as those described above, and therefore will not be repeated herein for the sake of brevity.

It is noted that the first transistor M1, the second transistor M2, the third transistor M3, and the fourth transistor M4 may be n-type transistors while the driving transistor M0 is a p-type transistor. It can be understood by those skilled in this art that, the actions in each of the steps described above can be achieved as well by inverting the first driving signal S1, the second driving signal S2 and the third driving signal S3, this will not be repeatedly described herein. That is, if the first transistor, the second transistor, the third transistor, and the fourth transistor are n-type transistors while the driving transistor is a p-type transistor, then, in the node resetting step, the first driving signal and the third driving signal are at a high level and the second driving signal is at a low level, thus the first transistor, the third transistor, the fourth transistor, and the driving transistor are turned on and the second transistor is turned off;

in the threshold detecting step, the first driving signal is at a high level, the second driving signal is at a low level, and the third driving signal changes from a high level to a low level, thus, the first transistor and the third transistor are turned on, the second transistor and the fourth transistor are turned off, and the driving transistor will be turned off if the voltage difference between the gate electrode and the source electrode of the driving transistor is equal to the threshold voltage of the driving transistor;

in the data inputting step, the first driving signal changes from a high level to a low level, the second driving signal changes from a low level to a high level, and the third driving signal is at a low level, thus the first transistor, the third transistor, the fourth transistor, and the driving transistor are turned off and the second transistor is turned on; and in the light emitting step, the first driving signal is at a low level, the second driving signal is at a high level and the third driving signal changes from a low level to a high level, thus the first transistor and the third transistor are turned off, the second transistor and the fourth transistor are turned on, and the driving current of the driving transistor is determined by the voltage difference between the gate electrode and the source electrode of the driving transistor.

The effect of compensating the threshold voltage and power supply line voltage drop is realized by this embodiment. Moreover, during the entire driving process of the pixel compensation circuit, it is ensured that the voltages at both ends of a storage capacitor will not change simultaneously, so as to reduce the impact of a parasitic capacitance coupling effect on the potential of a node, and to solve the problem of inaccurate threshold detecting, thus the threshold voltage is precisely compensated to achieve a good display effect.

It should be noted that the above description only describes some embodiments and technical principles of the present invention. Those skilled in this art will understand that the present invention is not limited to the specific embodiments described herein, and various apparent changes, rearrangements and substitutions may be made by those skilled in this art without departing from the protecting scope of the present invention. Therefore, although the present invention has been described in detail as above in connection with the embodiments, the present invention is not to limit thereto and may include other equivalent embodiments without departing from the conception of the present invention. However, the protecting scope of the present invention is defined by the following appended claims.

What is claimed is:

1. A pixel compensation circuit for an organic light emitting display, comprising a first transistor, a second transistor, a third transistor, a fourth transistor, a driving transistor, and a capacitor, wherein the first transistor is configured to transmit a data signal to a first plate of the capacitor in response to a first driving signal;

the second transistor is configured to apply a reference voltage to the first plate of the capacitor in response to a second driving signal;

the driving transistor is configured to determine a magnitude of a driving current, wherein the driving current depends on a voltage difference between a gate electrode and a source electrode of the driving transistor;

the third transistor is configured to establish a connection between the gate electrode and a drain electrode of the driving transistor in response the first driving signal; and the fourth transistor is configured to pass the driving current from the driving transistor to an organic light emitting element in response to a third driving signal;

wherein a time sequence of the pixel compensation circuit comprises a node reset stage, a threshold detecting stage, a data inputting stage, and a light emitting stage, during the node reset stage, the first transistor, the third transistor and the fourth transistor are turned on, the second transistor is turned off;

during the threshold detecting stage, the first transistor and the third transistor are turned on, the second transistor and the fourth transistor are turned off;

during the data inputting stage, the first transistor, the third transistor and the fourth transistor are turned off, the second transistor is turned on; and during the light emitting stage, the first transistor and the third transistor are turned off, the second transistor and the fourth transistor are turned on.

2. The pixel compensation circuit according to claim 1, wherein:

a first electrode of the first transistor is connected to a data signal line, and a second electrode of the first transistor is connected to a second electrode of the second transistor and the first plate of the capacitor;

a first electrode of the second transistor is connected to a reference voltage line;

the source electrode of the driving transistor is connected to a power supply voltage line, and the drain electrode of the driving transistor is connected to a second electrode of the third transistor and a first electrode of the fourth transistor;

a first electrode of the third transistor is connected to the gate electrode of the driving transistor and a second plate of the capacitor; and a second electrode of the fourth transistor is connected to the organic light emitting element.

3. The pixel compensation circuit according to claim 2, wherein:

the first transistor, the second transistor, the third transistor, the fourth transistor, and the driving transistor are p-type transistors; or the first transistor, the second transistor, the third transistor, and the fourth transistor are n-type transistors and the driving transistor is a p-type transistor.

4. The pixel compensation circuit according to claim 1, wherein, in the node reset stage, a low voltage at a cathode of the organic light emitting element is applied to the gate electrode of the driving transistor through the third transistor and the fourth transistor to turn on the driving transistor; and the data signal is transmitted to the first plate of the capacitor through the first transistor.

5. The pixel compensation circuit according to claim 1, wherein, in the threshold detecting stage, a power supply voltage is applied to a second plate of the capacitor through the third transistor and the driving transistor, and the driving transistor is turned off when the voltage difference between the gate electrode and the source electrode of the driving transistor is equal to a threshold voltage of the driving transistor;

when the driving transistor is turned off, the threshold voltage of the driving transistor is stored on the capacitor.

6. The pixel compensation circuit according to claim 1, wherein, in the data inputting stage, a reference voltage is applied to the first plate of the capacitor through the second transistor, and the data signal is coupled to a second plate of the capacitor through the capacitor.

7. The pixel compensation circuit according to claim 1, wherein, in the light emitting stage, the source electrode of the driving transistor has a voltage equal to a power supply voltage; and the organic light emitting element emits light in response to the driving current.

8. A method for pixel compensation using a pixel compensation circuit, comprising:

resetting a node by turning on a first transistor, a third transistor and a fourth transistor and turning off a second transistor;

detecting a threshold by turning on the first transistor and the third transistor, and turning off the second transistor and the fourth transistor;

inputting a data signal by turning on the second transistor and turning off the first transistor, the third transistor and the fourth transistor; and emitting light by turning on the second transistor and the fourth transistor and turning off the first transistor and the third transistor;

wherein the first transistor is configured to transmit a data signal to a first plate of a capacitor in response to a first driving signal, wherein the second transistor is configured to apply a reference voltage to the first plate of the capacitor in response to a second driving signal, wherein the driving transistor is configured to determine a magnitude of a driving current, wherein the driving current depends on a voltage difference between a gate electrode and a source electrode of the driving transistor, wherein the third transistor is configured to establish a connection between the gate electrode and the drain electrode of the driving transistor in response to the first driving signal, and wherein the fourth transistor is configured to pass the driving current from the driving transistor to an organic light emitting element in response to a third driving signal.

9. The method for pixel compensation according to claim 8, wherein the driving transistor is turned on during resetting a node.

10. The method for pixel compensation according to claim 8, wherein during detecting the threshold:

the driving transistor is turned on until a voltage difference between the gate electrode and the source electrode of the driving transistor is equal to a threshold voltage of the driving transistor.

11. The method for pixel compensation according to claim 8, wherein during inputting the data signal:

the driving transistor is turned off.

12. The method for pixel compensation according to claim 8, wherein during emitting light:

the driving transistor is turned on.

13. The method for pixel compensation according to claim 8, wherein resetting the node comprises: changing the data signal from a low level to a high level; and detecting the threshold comprises: changing the data signal from a high level to a low level.

14. The method for pixel compensation according to claim 13, wherein resetting the node further comprises: changing the first driving signal after the data signal has changed from the low level to the high level; and detecting the threshold further comprises: changing the first driving signal before the data signal changes from the high level to the low level.

15. An organic light emitting display comprising a pixel compensation circuit and an organic light emitting element, wherein the pixel compensation circuit comprises a first transistor, a second transistor, a third transistor, a fourth transistor, a driving transistor, and a capacitor, wherein:

the first transistor is configured to transmit a data signal to a first plate of the capacitor in response to a first driving signal;

the second transistor is configured to apply a reference voltage to the first plate of the capacitor in response to a second driving signal;

the driving transistor is configured to determine a magnitude of a driving current, wherein the driving current depends on a voltage difference between a gate electrode and a source electrode of the driving transistor;

the third transistor is configured to control the connecting and disconnecting between the gate electrode and the drain electrode of the driving transistor in response to the first driving signal; and the fourth transistor is configured to pass the driving current from the driving transistor to an organic light emitting element in response to a third driving signal, wherein the organic light emitting element is configured to emit light in response to the driving current;

and wherein a time sequence of the pixel compensation circuit comprises a node reset stage, a threshold detecting stage, a data inputting stage, and a light emitting stage, during the node reset stage, the first transistor, the third transistor and the fourth transistor are turned on, the second transistor is turned off;

during the threshold detecting stage, the first transistor and the third transistor are turned on, the second transistor and the fourth transistor are turned off;

during the data inputting stage, the first transistor, the third transistor and the fourth transistor are turned off, the second transistor is turned on; and during the light emitting stage, the first transistor and the third transistor are turned off, the second transistor and the fourth transistor are turned on.

16. A pixel compensation circuit for an organic light emitting display, comprising a first transistor, a second transistor, a third transistor, a fourth transistor, a driving transistor, and a capacitor, wherein the first transistor is configured to transmit a data signal to a first plate of the capacitor in response to a first driving signal, the second transistor is configured to apply a reference voltage to the first plate of the capacitor in response to a second driving signal, the driving transistor is configured to determine a magnitude of a driving current, wherein the driving current depends on a voltage difference between a gate electrode and a source electrode of the driving transistor, the third transistor is configured to establish a connection between the gate electrode and a drain electrode of the driving transistor in response the first driving signal, the fourth transistor is configured to pass the driving current from the driving transistor to an organic light emitting element in response to a third driving signal;

wherein a time sequence of the pixel compensation circuit comprises a node reset stage, a threshold detecting stage, a data inputting stage, and a light emitting stage;

wherein during the node reset stage, the first transistor, the third transistor and the fourth transistor are turned on, the second transistor is turned off;

wherein during the threshold detecting stage, the first transistor and the third transistor are turned on, the second transistor and the fourth transistor are turned off;

wherein during the data inputting stage, the first transistor, the third transistor and the fourth transistor are turned off, the second transistor is turned on;

wherein during the light emitting stage, the first transistor and the third transistor are turned off, the second transistor and the fourth transistor are turned on; and wherein when the first driving signal is at high level, the second driving signal is at low level and when the first driving signal is at low level, the second driving signal is at high level.

17. The pixel compensation circuit according to claim 16, wherein during the light emitting stage, a potential difference between the first plate and the second plate of the capacitor is Vdata+Vth, wherein Vdata denotes the data signal and Vth denotes a threshold voltage of the driving transistor.

* * * * *